US008210706B2

(12) United States Patent
Rooymans et al.

(10) Patent No.: US 8,210,706 B2
(45) Date of Patent: Jul. 3, 2012

(54) STREET LIGHTING ARRANGEMENT

(75) Inventors: Johannes Otto Rooymans, Ermelo (NL); Antonius Willem Verburg, Eindhoven (NL)

(73) Assignee: Innolumis Public Lighting B.V., Almere (NL)

( * ) Notice: Subject to any disclaimer, the term of this patent is extended or adjusted under 35 U.S.C. 154(b) by 319 days.

(21) Appl. No.: 12/670,684

(22) PCT Filed: Jul. 23, 2008

(86) PCT No.: PCT/EP2008/059669
§ 371 (c)(1),
(2), (4) Date: Jan. 26, 2010

(87) PCT Pub. No.: WO2009/013320
PCT Pub. Date: Jan. 29, 2009

(65) Prior Publication Data

US 2010/0202140 A1 Aug. 12, 2010

(30) Foreign Application Priority Data

Jul. 26, 2007 (EP) ..... 07113195

(51) Int. Cl.
*F21V 7/00* (2006.01)

(52) U.S. Cl. ..... 362/153.1; 362/231; 362/249.02

(58) Field of Classification Search ..... 362/145, 362/153.1, 218, 217.05, 231, 241, 249.23
See application file for complete search history.

(56) References Cited

U.S. PATENT DOCUMENTS

| | | | | |
|---|---|---|---|---|
| 6,250,774 | B1 * | 6/2001 | Begemann et al. | 362/231 |
| 2004/0196653 | A1 | 10/2004 | Clark et al. | |
| 2006/0007013 | A1 | 1/2006 | Singer et al. | |
| 2007/0211463 | A1 | 9/2007 | Chevalier et al. | |
| 2010/0321930 | A1 * | 12/2010 | Watanabe et al. | 362/231 |

FOREIGN PATENT DOCUMENTS

| | | | |
|---|---|---|---|
| CN | 1945104 | A | 4/2007 |
| EP | 1557604 | A | 7/2005 |
| GB | 540053 | A | 2/1941 |
| GB | 559646 | A | 2/1944 |
| JP | 2006277979 | A | 10/2006 |
| JP | 2007165051 | A | 6/2007 |
| WO | 2006132533 | A2 | 12/2006 |
| WO | 2007100837 | A2 | 9/2007 |

* cited by examiner

*Primary Examiner* — David V Bruce
(74) *Attorney, Agent, or Firm* — Hoyng Monegier LLP; David P. Owen; Coraline Haitjema

(57) ABSTRACT

A street lighting arrangement for providing light distribution over an angular range between an axis and a cut-off angle, the arrangement comprising a first array (1) of at least one LED (2) having a substantially planar distribution pattern, the first array being directed at an angle intermediate to the axis and the cut-off angle, a second array of at least one LED having a substantially planar distribution pattern, the second array being directed at an angle intermediate to the axis and the cut-off angle and generally opposite to the first array, a first reflector (14) directed to receive light from the first array (1) beyond the cut-off angle and reflect it as a substantially parallel beam in the direction of the second array at close to the cut-off angle and a second reflector directed to receive light from the second array beyond the cut-off angle and reflect it as a substantially parallel beam in the direction of the first array (1) and at close to the cut-off angle.

32 Claims, 6 Drawing Sheets

STREET LIGHTING ARRANGEMENT

BACKGROUND OF THE INVENTION

1. Field of the Invention

The invention relates generally to lighting arrangements using light emitting diodes (LEDs) and more particularly to LED lighting arrangements for use in illuminating public spaces such as roads and bicycle paths.

2. Description of the Related Art

Reflector units for streetlights are designed to distribute the light as evenly as possible over the area to be illuminated with minimal disturbance of the vision by glare and blinding. The optical design should meet an optimal balance between mast height, light uniformity, illumination coverage and the angle of glare and blinding of the light.

Glare is defined as a difficulty seeing in the presence of very bright light. Glare is stronger when bright light shines frontally into the face of a viewer than when shining at an angle. For a street light, the frontal angle perceived by a viewer approaching the light is known as the threshold increment (Ti). This angle is generally specified by designers such that the light shines at an angle of not less than 20° with the horizontal axis. A form of cut-off using the lighting unit surround may be used to achieve this. Nevertheless, reflection and refraction of light passing through the transparent cover of the lamp can still give rise to glare and is also a cause of "light pollution"—light that is directed upwards. The extent to which glare reduction is actually achieved depends largely on the effectiveness of these measures.

A further important factor that determines glare is the perceived size of the source or light emitting area. The amount of light emitted from a source having a given light emitting area may be defined by its luminance and measured in candelas per unit area. In general, a given amount of light emitted uniformly from a large area leads to considerably lower glare than the same amount of light emitted from a smaller area.

Conventional light sources for street lighting have included incandescent, fluorescent and other discharge lamps. More recently, alternative low-energy designs have been developed using LED light sources which are of considerably higher luminance i.e. significantly more concentrated in terms of flux/mm$^2$. This highly concentrated light intensity together with the monochromatic character of special LED light sources requires a novel approach to the optical design. An additional factor in the design is the physical size of the point source. As indicated above, these factors are especially significant in terms of glare, since a small, bright point source can cause glare or blinding at even large distances.

Known solid state light sources of this type generally use lens optics mounted onto the chip. Typically, LEDs have an encapsulation with integrated lens to create beams with a desired opening angle e.g. 10° or 70°. Narrow beams are advantageous in that they have increased intensity and can be directed to the farthest points of a road. Existing designs for street lighting have attempted to use clusters of LEDs with increased light concentration close to the threshold increment in order to provide uniform distribution of light on the road surface. Concentrating point sources using lenses or collimators does nothing to overcome the problems of increased glare due to excessive luminance since the light emitting area of the LEDs remains small and the luminance increases with the square of the lens opening angle.

A device is described in PCT patent publication WO2006/132533 in which solid state light sources are provided with a light processing unit provided to process the intensity and/or direction of the generated light in order to illuminate specific regions of a road surface. Additionally, the device is designed to emit light in a first wavelength region and in a second wavelength region. According to the disclosure, the lighting unit is designed to generate light having a dominant wavelength from the first wavelength region in such a way that the eye sensitivity of the human eye is dominated by rods. Light in the second wavelength region is used for improving colour perception. Although the use of specific wavelengths can improve vision at low light intensity, the problems of glare remain.

Thus, there is a particular need for a lighting arrangement that combines the advantages of low power solid state light sources with reduced glare while providing a uniform light distribution over the road surface.

BRIEF SUMMARY OF THE INVENTION

The present invention addresses these problems by providing a street lighting arrangement for providing light distribution over an angular range between an axis and a cut-off angle, the arrangement comprising a first array of at least one LED having a substantially planar distribution pattern, the first array being directed at an angle intermediate to the axis and the cut-off angle, a second array of at least one LED having a substantially planar distribution pattern, the second array being directed at an angle intermediate to the axis and the cut-off angle and generally opposite to the first array, a first reflector directed to receive light from the first array beyond the cut-off angle and reflect it as a substantially parallel beam in the direction of the second array at close to the cut-off angle and a second reflector directed to receive light from the second array beyond the cut-off angle and reflect it as a substantially parallel beam in the direction of the first array and at close to the cut-off angle. In this manner, by taking the light that is emitted beyond the cut-off angle and reflecting it at about the cut-off angle the illumination at the furthest reaches of the lighting arrangement can be increased without increasing the intensity of the light source. Light cast at close to the cut-off angle of the first array will thus come partially from the first array and partially from the second reflector. Since these are spaced from one another, the effective size of the light source is also increased whereby its effective luminance is decreased.

Although reference in the following is made to LEDs, in the present context this is understood to refer to any suitable solid state device capable of emitting light. Such a device may be a diode or other form of junction or the like capable of efficiently converting electrical energy into light. Furthermore, reference to a planar distribution pattern is intended to refer to a non-focussed distribution of light. In particular for an LED, this is intended to refer to emission of light in a uniform manner over a solid angle of close to 180°, in particular more than 120° and preferably about 140° or more. As is understood by the skilled person, such planar distribution is never completely uniform and a greater intensity may be observed at an angle normal to the substrate on which the LED is mounted compared to angles closer to the substrate surface. Preferably, the planar distribution is achieved by a spherical encapsulation of the LED. Although reference is made to encapsulation, it is understood that any appropriate form of non-focussing cover may be applied over the individual LEDs. Generally, the cut-off angle will be chosen at or near 70° for most street lighting applications.

In a preferred embodiment of the invention, each array comprises a plurality of LEDs, each LED emitting substantially monochromatic light in one of at least two different wavelength regions. By using individual LED elements operating at a chosen frequency, maximum energy efficiency may be achieved. In particular, such LEDs have been found to be significantly longer lasting and more energy efficient than conventional broad spectrum "white" LEDs using phosphor. Furthermore, by using LEDs operating at chosen wavelengths, a desired spectral distribution can be achieved.

Most preferably, each array consists of a plurality of cyan or green LEDs emitting in the wavelength region of 500-525 nm and at least one red LED emitting in the wavelength region 580-625 nm. Scientific research indicates that this particular spectral combination provides a twice the light perception in the peripheral field of view.

A typical property of glare is that it is caused by the intensity and brightness of the light point on the surface of the eye and in the eye. Reflections on the wet surface of the eye disturb the vision. Refraction within the eye ball causes different breaking angles for different wavelengths. A lamp with full spectral distribution will cause a range of breaking angles in the eye for each different wavelength—known as chromatic aberration. The round shape of the eye can cause spherical aberration. By reducing the intensity of the light and by choice of a particular spectral configuration of the light source these effects can be substantially diminished. In particular, glare can be drastically reduced and peripheral vision improved. The light may be perceived as white light but is actually received by different receptors in the eye. Lowering the light intensity results in what is known as mesopic or "twilight" vision. At these levels, the rods in the eye are extra sensitive with a peak at 507 nm at the lowest light level, also called scotopic vision. The rods are not believed to be affected by red light at all. The longer wavelength red light is received by the red-sensitive cones in the eye and allows a sufficient degree of foveal vision and color contrast for street lighting requirement. In particular it is noted that the red sensitive cones make up around two thirds of the total cones on the retina and specifically addressing these receptors is therefore advantageous. Both wavelengths have different breaking angles and would thus form separate images at the retina. Nevertheless, they are also each received by different receptors and apparently processed separately by the brain. This appears to strongly reduce any perceived disturbance in vision. Furthermore, there should be no or minimal light in the intervening region of 525 to 580 nm. While not wishing to be bound by theory, it is believed that yellow light in this region causes saturation of the rod receptors and reduces the mesopic vision. The ratio between the lowest light level for vision, known as scotopic light, and photopic levels is expressed as S/P ratio. Current lamps reach a maximal S/P ratio of 1.5. The here described LED arrangement can provide a S/P ratio up to 5. The experienced double light intensity at low light levels is only found at S/P ratios higher than 2.

Although the precise intensity will vary according to the particular application, it is most preferable that each array delivers less than 300 lumens. By correct positioning of the lighting arrangement, this is sufficient to illuminate the chosen surface at an intensity of between 1 and 3 lux. In a convenient embodiment the LEDs are arranged in a matrix comprising two rows of three cyan LEDs and a row of two red LEDs located symmetrically between the cyan LEDs. This allows a compact spacing of the LEDs and an appropriate ratio of light in the red and cyan regions to ensure good mesopic vision with adequate colour perception. Preferably the matrix is based on a spacing of about 3.5 mm between adjacent LEDs of the same colour. According to an important aspect of the invention, such a matrix should be arranged and oriented to avoid isolated single colours being cast onto the area to be illuminated. This may be achieved by arranging the different coloured LEDs laterally next to one another within the matrix. In this context, the lateral direction is understood to be the direction perpendicular to the plane defined by the angular range of light distribution.

According to a further preferred embodiment of the invention, the reflector comprises no more than five flat focussing surfaces aligned with one another. In this context, the term flat is used to refer to a surface which is not itself intended to focus the light. It may nevertheless contain imperfections and need not be optically perfectly flat since it is not intended to form a visible image. It may also be shiny or matt. The term "flat focussing surfaces" is intended to designate the fact that the surfaces are angled with respect to one another in order approximate sections of a parabola having the respective array at its centre. In general, it has been found that three focussing surfaces are sufficient for most purposes. Preferably, the focussing surfaces may all be integrally formed in a single piece. By using flat surfaces in combination with light sources operating at different wavelengths, colour separation may be reduced. Prior art devices have used curved reflective mirrors. This however leads to drawbacks since on reflection by a curved surface, colours become separated and the resulting illumination is unacceptable for many purposes. It is also desirable that the size of the focussing surfaces is limited. In particular, it has been found that large surfaces create an undesirable perception of movement as an observer passes the lighting arrangement. This may be at least partially overcome by limiting the size of each focussing surface to the size of its array (around 7-10 mm). The perceived image of the LEDs then effectively fills the surface and no longer moves across it. It is understood that the focussing surface size relates to its height aligned with the direction of movement along the street. Its width may be considerably greater.

According to a further aspect of the invention, each array may be mounted on a heat sink in order to dissipate the heat produced by the light sources. The heat sink may be any appropriate conducting medium, preferably a metal e.g. aluminium sheet material. The LED array is preferably glued to it using a heat conducting adhesive, most preferably a UV hardening acryl adhesive.

Most preferably, the lighting arrangement comprises a substantially sealed housing enclosing the arrays and the reflectors. Since the working life of such LED light sources is significantly higher than conventional lights, the housing may be permanently sealed to prevent ingress of moisture or dirt. On failure, the complete unit will be replaced or recycled. Particularly in the case of such a sealed unit, good heat conduction from the LED to the exterior of the housing is desirable since the lifetime of LEDs is temperature dependent. This may be achieved by an appropriate conduction path from the LED or heat sink to the exterior. The exterior surface of the housing may provide sufficient heat dissipation by natural convection. Alternatively or additionally, heat conductors or heat tubes may connect to the lighting support or lamp post or to another heat exchange element.

In a preferred construction of the lighting arrangement, the heat sink comprises a pyramidal structure and the first and second arrays are mounted back to back on opposite faces of the heat sink. The heat sink may be a triangular prism having a base and two further faces generally aligned with the flat surfaces of the reflectors. Such an arrangement may be termed a 1-D lighting arrangement as it is designed to cast light along the direction of e.g. a street or path. In that case, the prism and the aligned reflectors will also be oriented across the direction of the street or path. Alternatively in a 2-D arrangement, the pyramidal structure may comprise three, four or more faces, depending on the manner in which the lighting arrangement is to be deployed. In general, the axis of the lighting arrangement may be defined with the pyramidal structure pointed in the direction of the axis. In this case, the faces of the heat sink are preferably angled at between 60° and 70° to the axis.

In an alternative construction, the arrays are mounted facing one another at an angle of around 60° to the axis and spaced by a distance D. Such an arrangement has a number of advantages as will be further described below. In particular, the arrangement may be made more compact, especially if the distance D also generally corresponds to the spacing between an array and its respective reflector.

In both of the above constructional arrangements, the arrays may be aligned or may be laterally offset from one another. By laterally offsetting the arrays, further spreading of the perceived light source may be achieved leading to a reduction in its intensity. In the arrangement where the arrays face one another, lateral offsetting also allows more effective reflector usage.

According to a further aspect of the invention, base reflectors are arranged between each array and its respective reflector. The base reflector is angled generally perpendicular to the axis i.e. it faces in the direction of the axis. At least part of the base reflector may however be angled slightly away from the axis in order to increase the reflection of light towards the furthest reaches. At least a portion of the base reflector may have a matt surface to act as a diffuser. The diffuser reflects light in all directions and serves to equalise the level of lighting in the direction of the axis.

According to a further feature of the invention, the arrangement also comprises a substantially transparent cap covering the arrays and reflectors over at least the angular range between the axis and the cut-off angle. The transparent cap is preferably shaped to ensure that both direct and reflected light is incident at an angle of around 90° whereby internal reflection and refraction of the radiated light on the inside of the transparent cover can be reduced. In an alternative embodiment, filling the optical side of the lamp completely with clear polyurethane reduces Fresnel reflections and avoids the so-called Brewster effect which normally occurs on the inside of a non-massive cover.

For the construction described above in which the arrays face one another, the cap may comprise first and second curved sections spaced by a distance D and generally overlying the respective first and second arrays with a generally planar section therebetween. The first curved section may have a centre of curvature located at about the position of the second array and vice-versa. Such an arrangement is geometrically well adapted to ensure perpendicular emission of light from the cap while avoiding a deep profile shape.

According to a particular feature of the invention, each array may be rated to operate at less than 10 Watts. In most circumstances, sufficient lighting at up to 3 lux may be achieved at an output of less than 8 Watts. Should increased coverage be required, a number of arrays can be assembled in a modular arrangement. In this manner, the lighting coverage is increased without increasing the luminance of the light source.

The invention also relates to an arrangement of the above described type, further comprising a lamppost, with the arrays and reflectors being mounted to the lamppost such that the axis of the arrangement points generally vertically downwards and wherein the lamppost supports the arrays at a height of at least three meters above the ground.

BRIEF DESCRIPTION OF THE DRAWINGS

Further features and advantages of the invention will be appreciated upon reference to the following drawings, in which.

DESCRIPTION OF ILLUSTRATIVE EMBODIMENTS

Figure 1:
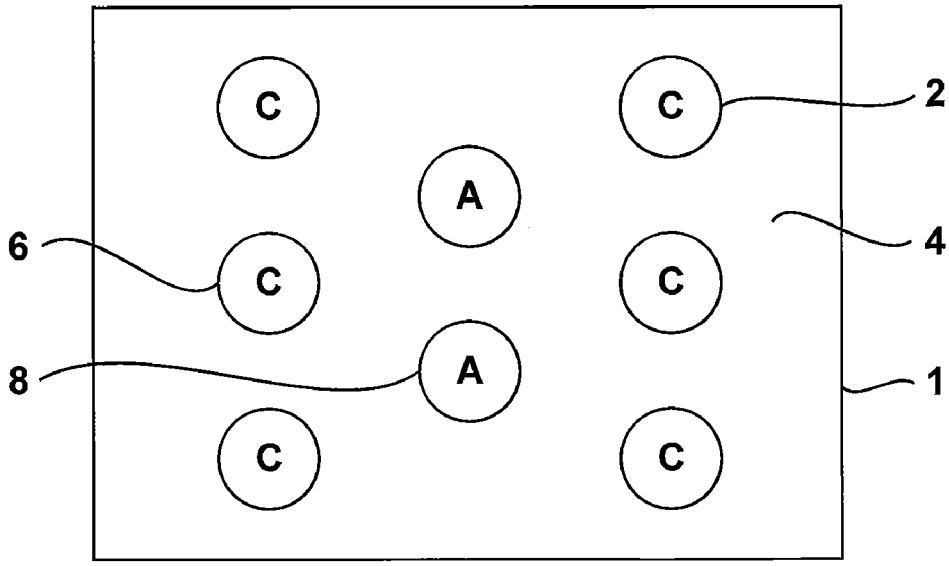
FIG. 1 is a plan view of an LED array for use in the invention.
Figure 2:
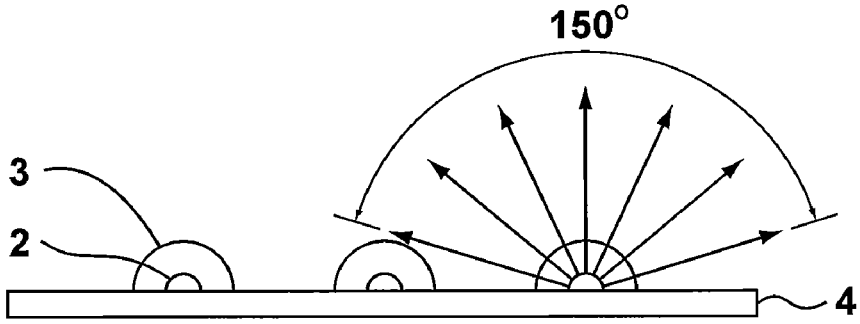
FIG. 2 is a side elevation view of the array of FIG. 1.

The following is a description of a number of embodiments of the invention, given by way of example only and with reference to the drawings. Referring to FIG. 1, there is shown an array 1 of light emitting diodes 2 mounted on a common substrate 4. The array consists of six cyan/green coloured LEDs 6 and two amber/red coloured LEDs 8. The LEDs are otherwise conventional and emit light in the wavelength bands of around 500 to 510 nm and 585 to 595 respectively. As shown in FIG. 2, the LEDs 2 are each covered by an encapsulation 3 of epoxy resin material. Each encapsulation 3 is substantially hemispherical such that light is emitted in a planar distribution pattern perpendicular to its surface and no significant refraction or focussing of the light takes place. The emitted light produces a generally uniform conical pattern having a solid angle of around 150°. Although not shown, it is understood that a common encapsulation of all of the LEDs 2 could also be used.

Figure 3:
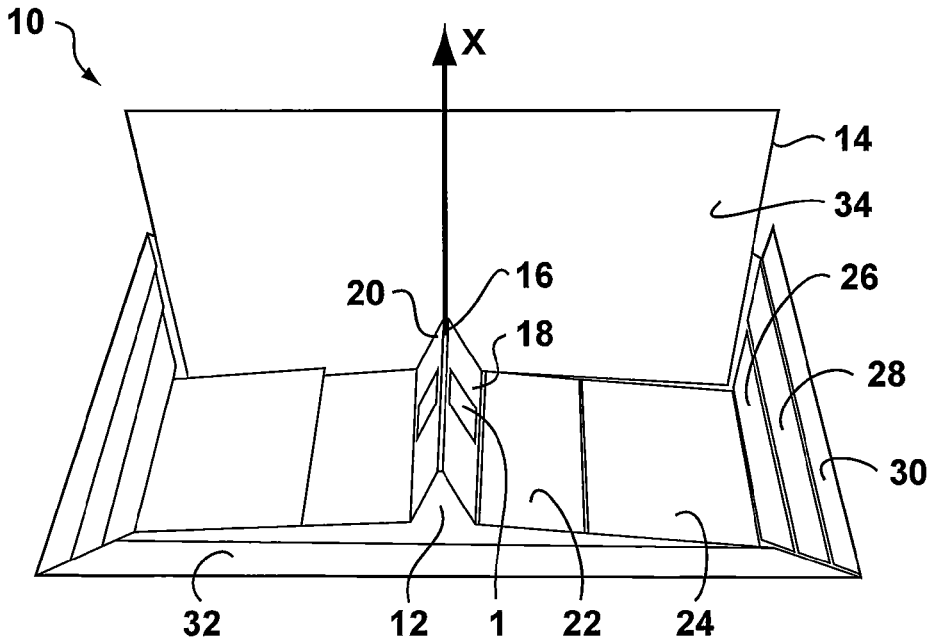
FIG. 3 is a perspective view of a lighting arrangement according to a first embodiment of the invention.

FIG. 3 shows a lighting arrangement 10 according to the present invention in which a pair of arrays 1 of the type shown in FIG. 1 have been mounted on a heat sink 12 forming part of a reflector arrangement 14. A housing and cap for enclosing the lighting arrangement are not shown for reasons of clarity. Heat sink 12 comprises a pyramidal structure in the form of a triangular prism. An apex 16 of the heat sink 12 is aligned in the direction of an axis X of the lighting arrangement 10. The arrays 1 are glued to first 18 and second 20 faces of the heat sink 12 using heat conductive adhesive.

The reflector arrangement 14 comprises a total of seven reflecting surfaces for each array 1. For the sake of clarity only the group of surfaces in front of face 18 will be described. It is however understood that the surfaces in front of face 20 are generally identical. Starting from the heat sink 12, five reflecting surfaces are arranged sequentially comprising a base reflector 22, a base diffuser 24 and first 26, second 28 and third 30 focussing surfaces. On either side of the heat sink 12 are arranged lateral surfaces 32, 34. The inclination of the lateral surfaces will not be further described at present but the skilled man will be aware of how to choose this in order to meet the requirements of road width and the like. All of the reflecting surfaces are bright and highly reflective except for the base diffuser 24 which is matt.

FIGS. 4A to 4E are cross sections through the lighting arrangement 10 of FIG. 3 perpendicular to apex 16 showing the incidence of light on different surfaces of the reflector arrangement 14. The arrangement 10 has also been turned upside-down into a use position in which the axis X coincides with a lamppost 36. The array 1 is shown to emit light over an angle of about 140°. In fact, the light is emitted in a conical pattern having a solid angle of around 140° but for the present purpose, only a 2-dimensional representation of the lighting pattern will be considered.

Figure 4A:
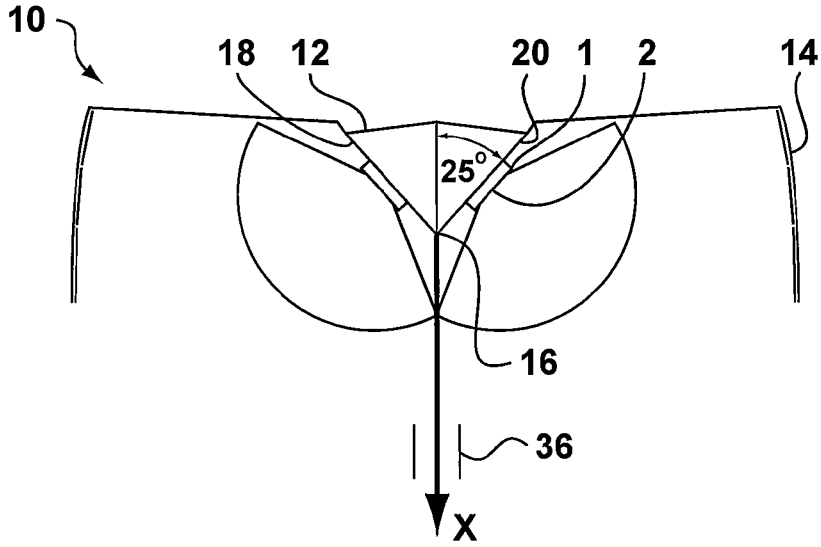
FIGS. 4A to 4E are schematic views of the light emission from the arrangement of FIG. 3.

As can be seen from FIG. 4A, the surfaces 18 and 20 of the heat sink 12 face at an angle of 25° away from the axis X and at 50° to one another. This angle is chosen in such a way that the radiation of the LED's 2 from both arrays 1 has a slight overlap when mounted at a height of 4 meters above the ground. When using a longer lamppost, the overlap will be greater or alternatively, a smaller angle may be used.

Figure 4B:
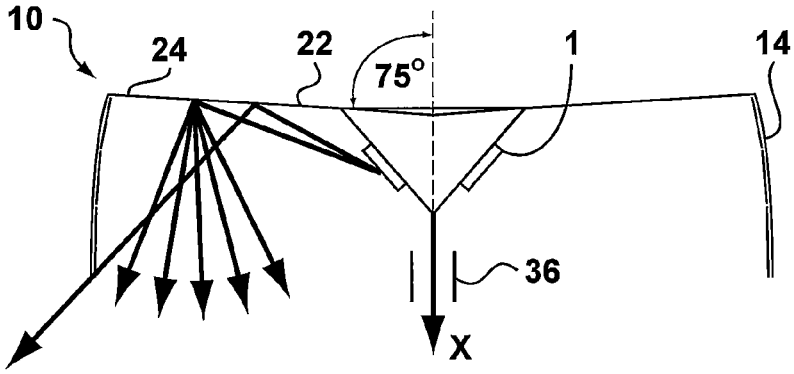

FIG. 4B shows base reflector 22 angled at around 75° away from axis X. Light from array 1 falling on base surface 22 is reflected away from axis X and passes over the third focussing surface 30 to provide additional light at a mid-range distance from the lamppost 36. Base diffuser 24 is an extension of base reflector 22 and is arranged at the same angle. Its matt surface causes incident light from array 1 to be scattered evenly in substantially all directions. This light is used primarily to equalize the lighting effect around the base of the lamppost 36.

Figure 4C:
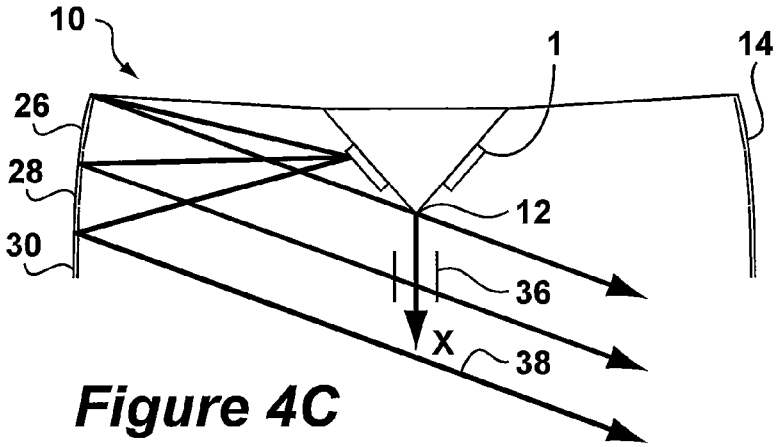

FIG. 4C shows first 26, second 28 and third 30 focussing surfaces located adjacent to the base diffuser 24 at a distance of around 7 cm from the heat sink 12. Each of focussing surfaces 26, 28, 30 has a height of around 7 mm corresponding to the size of array 1. Each is angled to form part of a quasi-parabolic surface directing incident light from the array 1 in a substantially parallel beam 38. Beam 38 passes over the heat sink 12 at between 60 and 70° to the axis X and provides additional illumination to the further regions from the lamppost 36 beneath the limit of the threshold increment.

Figure 4D:
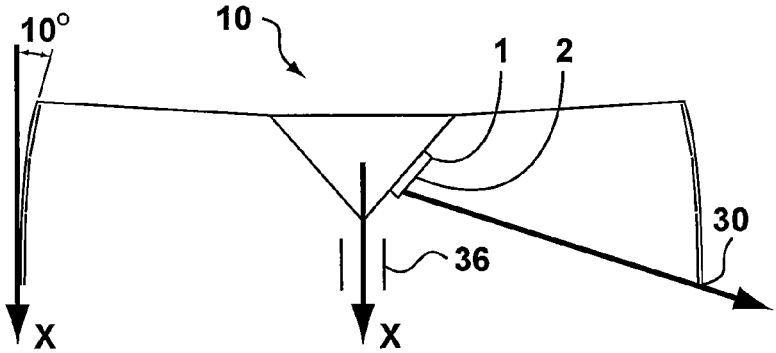

As shown in FIG. 4D, the surfaces 26, 28, 30 themselves are angled at between 0 and 10° to the axis X. The upper edge of surface 30 is located at a height such that direct light from the array can pass over it at an angle of between 60° and 70° to the axis X. This means that a person approaching the lighting arrangement 10 will not directly see the lowermost LED 2 until shortly before arriving at the lamppost 36.

Figure 4E:
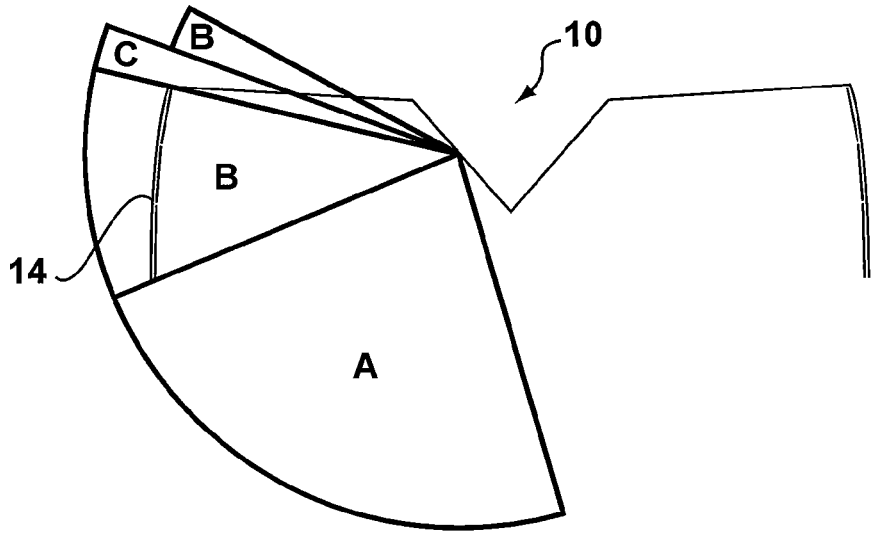

Based on the above dimensions the lighting arrangement 10 emits lights as shown in FIG. 4E in which A represents directly radiated light (about 50% of the light); B represents light reflected once (about 45% of the light); and C represent light reflected by the base diffuser (about 5% of the light). The light B is reflected with an efficiency of around 90%. About 50% of the diffused light C will be lost. In total, about 6% (10% of 45%+50% of 5%) of the light will be lost due to absorption in the reflector. The light radiated by the lighting arrangement is very uniform and homogenous. It has been found that the light pattern produced is equivalent to the light distribution of a streetlight with an average light intensity of class 5 and higher complying with an average light intensity of 3 lux and a uniformity greater than 0.2 (where uniformity is defined as the ration of the lowest horizontal luminance to the average horizontal luminance). This is achieved with a significantly reduced power input of less than 8 Watts per matrix. Based on this power rating and a 4.80 m high lamppost, a distance of up to 12 m can be correctly illuminated. A 6 m high lamppost can illuminate a distance of 30 m correctly with 15 Watt.

Figure 5:
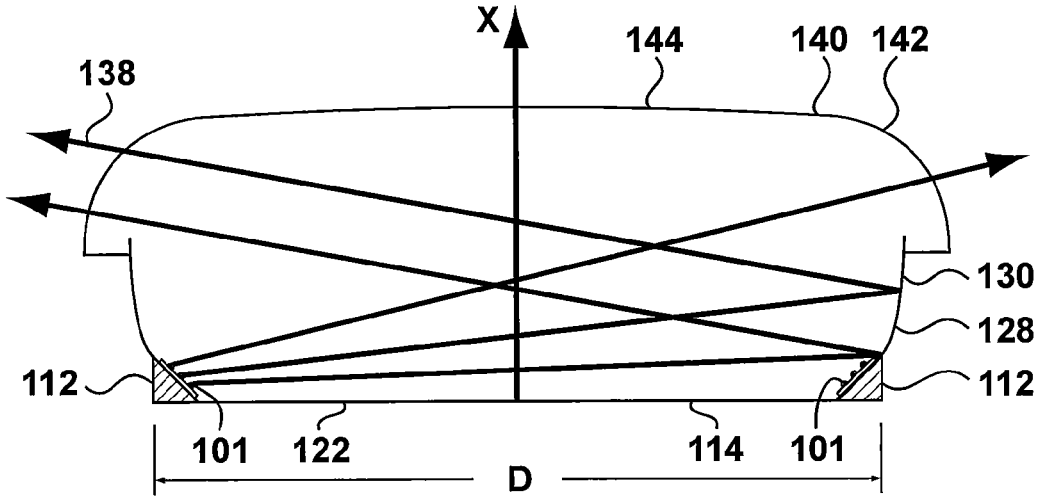
FIG. 5 is a cross-sectional view of a second embodiment of the invention.

FIG. 5 shows a lighting arrangement 110 according to a second embodiment of the present invention in which similar elements to the first embodiment are denoted by like reference numeral preceded by 100.

According to FIG. 5, a pair of arrays 101 are mounted facing one another on heat sinks 112. The arrays are preferably of the type shown in FIG. 1 although it will be understood that other LED structures may also be employed. The arrays 101 are mounted in a reflector arrangement 114. Behind each array are located second 128 and third 130 focusing surfaces. The distance between the opposed focussing surfaces 128, 130 is a distance D. It may be noted in this embodiment that a first focusing surface is absent as it has been replaced by the heat sink 112 that supports the array 101. The orientation of the arrays 101 and the reflector 114 is generally similar to that of the embodiment of FIGS. 3 and 4. Heat sinks 112 are angled at approximately 25° to an axis X of the arrangement 110. In other words, the surfaces of the heat sinks 112 and the arrays 101 face at an angle of 65° to the axis X. Focussing surfaces 128, 130 are angled close to the axis X such that light received from the array 101 is reflected as a generally parallel beam 138 at an angle of around 70° to the axis X. In the embodiment shown, the focussing surfaces 128, 130 are arranged immediately adjacent to the heat sinks 112 whereby arrays 101 are thus also located at a distance D from one another. It is of course also possible that the arrays are located closer together than their respective reflecting surfaces.

A base reflector 122 is arranged generally perpendicular to the axis X between the two arrays 101. The base reflector 122 reflects a portion of the light from both arrays. In this embodiment all of the surfaces of the reflector arrangement 114 are formed from slightly matt aluminium of MIRO 7 quality. This material has a total reflection value of about 94% and a diffuse reflection value of 84-90% according to DIN 5036-3 and a brightness of 55-65% according to DIN 67530. As in the previous embodiment, a majority (50%) of the light is emitted directly. Of the remaining light, around 30% is focussed by the surfaces 128, 130 and directed towards the extremities. The remaining light will be diffused over the area generally below the lamppost.

Also shown in FIG. 5 is a cap 140 for covering the arrangement 110. Cap 140 is formed of clear polycarbonate and comprises a pair of curved ends 142, separated by a generally flat central section 144. The flat central section 144 generally spans over the focussing surfaces 128, 130 and arrays 101 and is thus also greater than the distance D. The curved surfaces 142 provide sections of the cap 140 through which beam 138 can pass perpendicularly with little refraction. The remaining light from each array 101 passes primarily through the flat central section 144 and is thus relatively unaffected by separation of different wavelengths.

Figure 6:
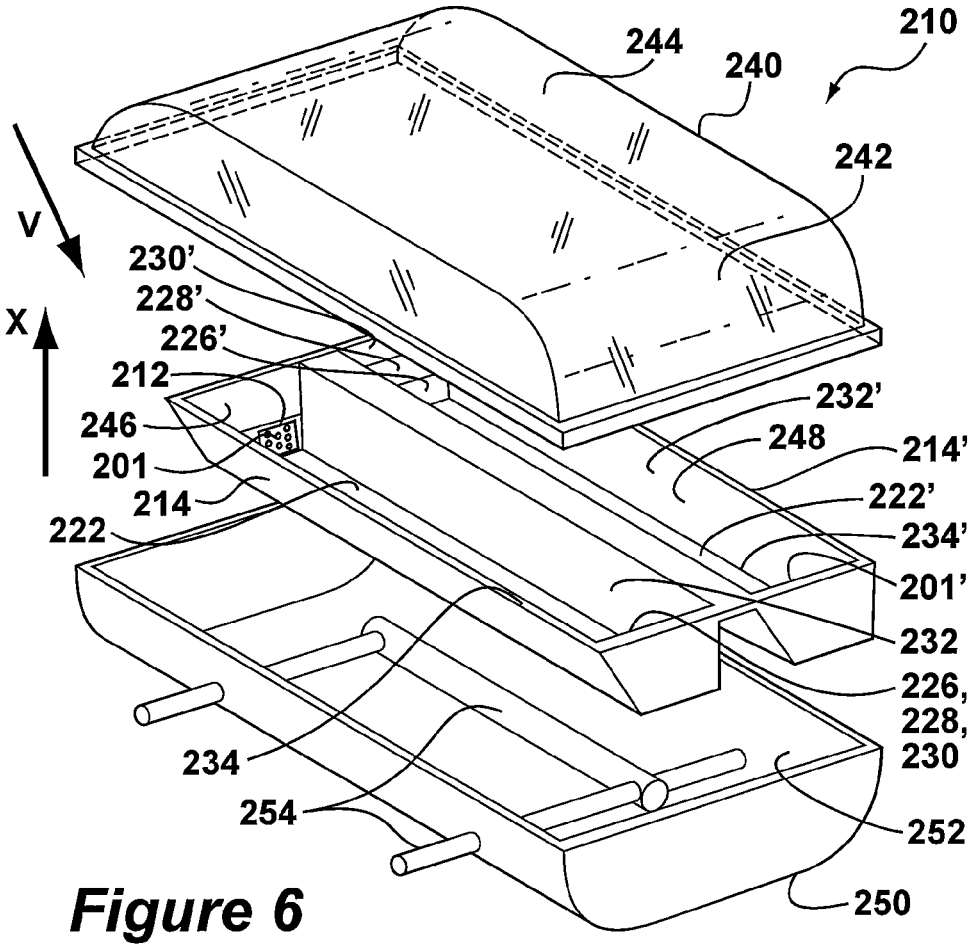
FIG. 6 is an exploded perspective view of a third embodiment of the invention.

FIG. 6 shows a lighting arrangement 210 according to a third embodiment of the present invention in which similar elements to the first embodiment are denoted by like reference numeral preceded by 200.

The third embodiment is generally similar to the configuration of FIG. 5, with the distinction that the lighting arrangement 210 is split laterally between first and second channels 246, 248 having two partial reflector arrangements 214, 214'. The reflector arrangements 214, 214' are also manufactured using aluminium of MIRO 7 quality. A first array 201 is supported upon a heat sink 212 located within the first channel 246. At an opposed end of the first channel 246 are located first 226, second 228 and third 230 focussing surfaces, not visible in this view. Adjacent to focussing surfaces 226, 228, 230 and located within the second channel 248 is a second array 201', not visible in this view but generally identical to the first array 201. Facing the second array 201' at the opposite end of the second channel 246 are first 226', second 228' and third 230' focussing surfaces of second reflector arrangement 214'. Each partial reflector arrangement 214, 214' also has a base reflector 222, 222' and lateral surfaces 232, 232' and 234, 234'. It is noted that lateral surfaces 232, 232' are generally vertical (parallel to axis X), while lateral surfaces 234, 234' are angled at around 45° to the axis. Such a lighting arrangement is designed to be situated at one side of a street or path and angled lateral surfaces 234, 234' allow the light to be cast sideways across the width of the street.

FIG. 6 also shows cap 240 for covering the lighting arrangement 210 and housing 250 which together with cap 240 forms an effectively sealed unit. Cap 240 is of a low profile configuration as described in relation to FIG. 5 and comprises curved ends 242 separated by generally flat central section 244. Housing 250 is formed of cast aluminium and has a recess 252 for receiving the reflector arrangements 214, 214'. Located within the recess 252 are heat pipes 254 arranged to act as a heat conduction path from arrays 201, 201' to the exterior of the housing. Heat pipes 254 also serve as conduits for electrical connections to the arrays 201, 201' and for connection of the lighting arrangement 210 to an external support or lamppost.

Figure 7:
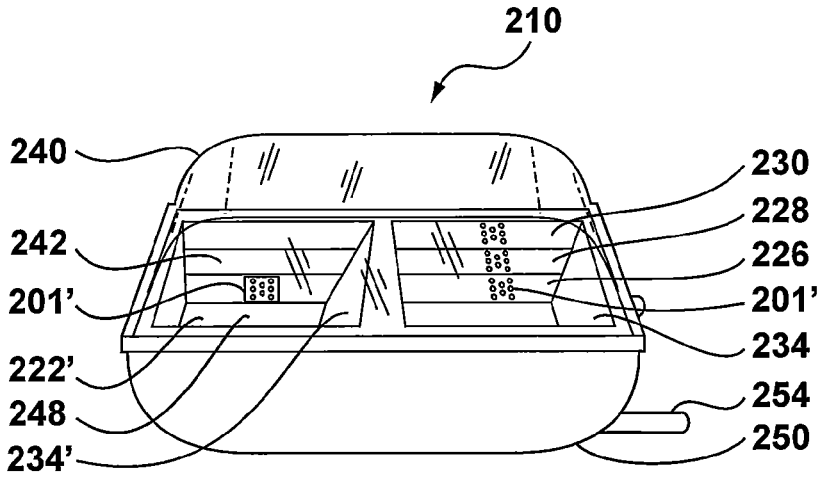
FIG. 7 is a perspective view of the lighting arrangement of FIG. 6 in an assembled state.

FIG. 7 shows a further view of the assembled lighting arrangement 210 looking in the direction of the threshold increment or cut-off angle according to arrow V in FIG. 6. At this angle, the first array 201 is not seen directly but appears reflected in each of the focussing surfaces 226, 228 and 230. Array 201' is seen directly within the second channel 248. As can also be seen in this orientation, the view of the array 201' and the reflected images of array 201 takes place through the end 242 of the cap 240.

Furthermore, in FIG. 7, assuming a LED-arrangement as schematically shown in FIG. 1, the orientation of the array 201, 201' with respect to the reflector arrangements 214, 214' is such that the plurality of cyan LEDs and the red LEDs are arranged next to each other in a direction perpendicular to a plane defined by the angular range of light distribution. Such an arrangement avoids that isolated single colours are cast onto the area to be illuminated.

Figure 8:
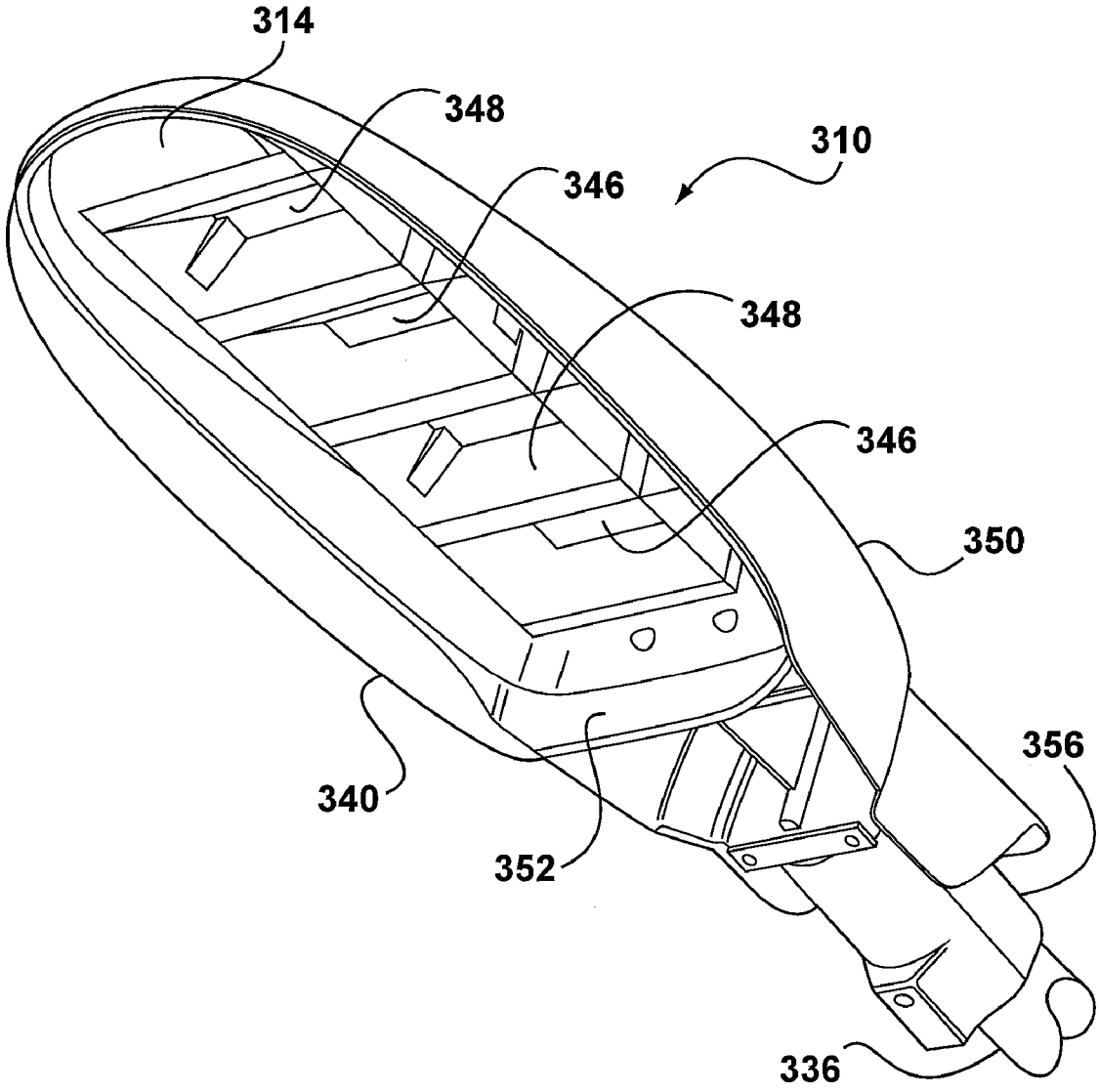
FIG. 8 is a perspective view of a multi-channel lighting arrangement according to a fourth embodiment of the invention.

FIG. 8 shows a perspective view of a fourth embodiment of a multi-channel lighting arrangement 310 similar to that of FIGS. 6 and 7. Similar elements to the first embodiment are denoted by like reference numeral preceded by 300.

According to FIG. 8, lighting arrangement 310 comprises two sets of first and second channels 346, 348 otherwise identical to those of FIG. 6. Cap 340 and housing 350 together form a sealed unit. Housing 350 is formed of cast aluminium and has a recess 352 for receiving the reflector arrangements 314. Bracket 356 allows for connection of the lighting arrangement 310 to an external support or lamppost 336.

Thus, the invention has been described by reference to the preferred embodiments as discussed above. It will be recognized that these embodiments are susceptible to various modifications and alternative forms well known to those of skill in the art. For example, the reflector may be made in a modular manner and placed in cascade with additional arrays for higher intensity and/or higher masts. In particular, the reflector arrangements of FIGS. 6, 7 and 8 may be formed with additional channels according to the desired lighting output. In FIG. 3, the prism shaped heat sink could be extended for location of further arrays. Alternatively, instead of a prism, a three sided or four sided pyramid could also be used for lighting of wider areas.

Many other modifications in addition to those described above may be made to the structures and techniques described herein without departing from the spirit and scope of the invention. Accordingly, although specific embodiments have been described, these are examples only and are not limiting upon the scope of the invention.

What is claimed is:

1. A street lighting arrangement for providing light distribution over an angular range between an axis and a cut-off angle, the arrangement comprising:

a first array of light sources comprising at least one LED having a substantially planar light distribution pattern, the first array being directed at an angle intermediate to the axis and the cut-off angle;

a second array of light sources comprising at least one LED having a substantially planar light distribution pattern, the second array being directed at an angle intermediate to the axis and the cut-off angle and generally opposite to the first array;

a first reflector comprising a plurality of reflecting surfaces positioned to receive light emitted from the first array at angles greater than the cut-off angle, the first reflector comprising a portion positioned to reflect a portion of the light from the first array at close to the cut-off angle as a substantially parallel beam generally in the direction of the second array; and a second reflector comprising a plurality of reflecting surfaces positioned to receive light emitted from the second array at angles greater than the cut-off angle, the second reflector comprising a portion positioned to reflect a portion of the light from the second array at close to the cut-off angle as a substantially parallel beam generally in the direction of the first array.

2. The street lighting arrangement of claim 1, wherein the first and second arrays are directed away from each other.

3. The street lighting arrangement of claim 2, wherein the first and second arrays are mounted back to back at an angle to the axis.

4. The street lighting arrangement of claim 1, wherein the first and second arrays are directed towards each other.

5. The street lighting arrangement of claim 4, wherein the first and second arrays are mounted facing one another at an angle to the axis and spaced apart.

6. The street lighting arrangement of claim 4, wherein the first and second arrays are laterally offset with respect to one another.

7. The street lighting arrangement of claim 1, wherein each array comprises a plurality of LEDs, each LED emitting substantially monochromatic light in one of at least two different wavelength regions.

8. The street lighting arrangement of claim 7, wherein each array has an s/p ratio greater than 2.0.

9. The street lighting arrangement of claim 7, wherein each array consists of a plurality of cyan LEDs emitting in the wavelength region of 500-525 nm and at least one red LED emitting in the wavelength region 580-625 nm.

10. The street lighting arrangement of claim 9, wherein the plurality of cyan LEDs and the at least one red LED are arranged next to each other in a direction perpendicular to a plane defined by the angular range of light distribution.

11. The street lighting arrangement of claim 1, further comprising first and second base reflectors arranged between each array and its respective reflector and being generally perpendicular to the axis.

12. The street lighting arrangement of claim 11, wherein at least a part of the first or second base reflectors comprises a matt surface arranged to reflect light in a diffuse manner.

13. The street lighting arrangement of claim 1, wherein the cut-off angle is in a range of about 60 to 70 degrees to the axis.

14. The street lighting arrangement of claim 1, wherein the arrays are mounted in a housing, and each array is mounted on a heat sink and is provided with a heat conduction path to an exterior of the housing.

15. A street lighting arrangement having first and second sides, for providing light generally in a first direction distributed over an angular range between a first cut-off angle on the first side and a second cut-off angle on the second side, the arrangement comprising:

a first array of LEDs positioned facing towards the first side and at an angle intermediate to the first direction and the first cut-off angle;

a second array of LEDs positioned facing towards the second side and at an angle intermediate to the first direction and the second cut-off angle;

a first reflector comprising a plurality of reflecting surfaces including a first reflecting surface facing substantially towards the second side and positioned so that light emitted from the first array at an angle close to and less than the first cut-off angle passes over the first reflecting surface and light emitted from the first array at an angle close to and greater than the first cut-off angle is reflected in a direction towards the second side; and a second reflector comprising a plurality of reflecting surfaces including a second reflecting surface facing substantially towards the first side and positioned so that light emitted from the second array at an angle close to and less than the second cut-off angle passes over the second reflecting surface and light emitted from the second array at an angle close to and greater than the second cut-off angle is reflected in a direction towards the second side.

16. The street lighting arrangement of claim 15, wherein the first and second arrays are directed away from each other.

17. The street lighting arrangement of claim 16, wherein the first and second arrays are mounted back to back at an angle to the axis.

18. The street lighting arrangement of claim 15, wherein the first and second arrays are mounted facing one another at an angle to the axis and spaced apart.

19. The street lighting arrangement of claim 18, wherein the first and second arrays are laterally offset with respect to one another.

20. The street lighting arrangement of claim 15, wherein each LED emits substantially monochromatic light in one of at least two different wavelength regions.

21. The street lighting arrangement of claim 20, wherein each array has an s/p ratio greater than 2.0.

22. The street lighting arrangement of claim 20, wherein each array consists of a plurality of cyan LEDs emitting in the wavelength region of 500-525 nm and at least one red LED emitting in the wavelength region 580-625 nm.

23. The street lighting arrangement of claim 22, wherein the plurality of cyan LEDs and the at least one red LED are arranged next to each other in a direction perpendicular to a plane defined by the angular range of light distribution.

24. A street lighting arrangement comprising a plurality of arrays of LEDs and a plurality of reflectors for distributing light emitted by the LEDs, wherein the arrangement comprises:

a first array of LEDs arranged facing a first reflector at an angle, the first reflector having a portion at its periphery for reflecting a part of the light emitted by the first array at an angle greater than a cut-off angle; and a second array of LEDs arranged facing a second reflector at an angle, the second reflector having a portion at its periphery for reflecting a part of the light emitted by the second array at an angle greater than a cut-off angle;

wherein the first reflector portion is arranged for reflecting the part of the light from the first array towards the second array and the second reflector so that the light passes over the second reflector portion; and wherein the second reflector portion is arranged for reflecting the part of the light from the first array towards the first array and the first reflector so that the light passes over the first reflector portion.

25. The street lighting arrangement of claim 24, wherein the first and second arrays are directed away from each other.

26. The street lighting arrangement of claim 25, wherein the first and second arrays are mounted back to back at an angle.

27. The street lighting arrangement of claim 24, wherein the first and second arrays are mounted facing one another at an angle to the axis and spaced apart.

28. The street lighting arrangement of claim 27, wherein the first and second arrays are laterally offset with respect to one another.

29. The street lighting arrangement of claim 24, wherein each LED emits substantially monochromatic light in one of at least two different wavelength regions.

30. The street lighting arrangement of claim 29, wherein each array has an s/p ratio greater than 2.0.

31. The street lighting arrangement of claim 29, wherein each array consists of a plurality of cyan LEDs emitting in the wavelength region of 500-525 nm and at least one red LED emitting in the wavelength region 580-625 nm.

32. The street lighting arrangement of claim 31, wherein the plurality of cyan LEDs and the at least one red LED are arranged next to each other in a direction perpendicular to a plane defined by the angular range of light distribution.

* * * * *